United States Patent [19]

Livermore

[11] 3,959,542

[45] May 25, 1976

[54] ARTIFICIAL SKI MATTING

[76] Inventor: Paul A. Livermore, 964 N. Larrabee - No. 101-A, Los Angeles, Calif. 90069

[22] Filed: July 12, 1974

[21] Appl. No.: 487,915

[52] U.S. Cl. ..... 428/44; 272/56.5 SS; 404/41; 428/17; 428/85; 428/89; 428/92; 428/95

[51] Int. Cl.² ..... B32B 3/10

[58] Field of Search ..... 404/41; 272/56.5 SS; 161/62–67, 48; 428/85, 91, 92, 88, 89, 17, 44, 47, 48, 95, 15

[56] References Cited

UNITED STATES PATENTS

| | | | |
|---|---|---|---|
| 3,350,092 | 10/1967 | Maki | 272/56.5 SS |
| 3,390,044 | 6/1968 | Malakoff | 161/48 |
| 3,443,493 | 5/1969 | Del Piano et al. | 272/56.5 SS |
| 3,522,618 | 9/1970 | Stranzinger | 404/41 X |
| 3,547,749 | 12/1970 | White et al. | 272/56.5 SS |
| 3,570,846 | 3/1971 | Weber et al. | 272/56.5 SS |
| 3,574,107 | 4/1971 | Hurka | 272/56.5 SS X |
| 3,581,630 | 6/1971 | Del Piano | 401/41 |
| 3,616,107 | 10/1971 | Kuzmick | 428/17 |
| 3,821,064 | 6/1974 | Cima | 272/56.5 SS X |

*Primary Examiner*—Marion E. McCamish
*Attorney, Agent, or Firm*—Poms, Smith Lande & Glenny

[57] ABSTRACT

An artificial ski matting wherein a plurality of ski mats may be interlocked to form an artificial skiing surface. Each mat includes a base ski support surface and an plurality of spaced pegs having flexible "fluff" fingers on each peg. A second plurality of spaced pegs are interposed on the mat and having flexible "turn" fingers on each peg. The "fluff" fingers form a generally horizontal ski surface permitting skis to sink into the fluff fingers and track on the mat as a ski would do in natural snow. The "turn" fingers form a generally horizontal ski surface lower than the first-mentioned horizontal ski surface permitting skis to dig into the mat and "turn" thereon. Finally, the base ski support surface supports the skis when they dig down into the mat, such as when sufficient centrifugal force is created either in a dip or turn while skiing. In this manner, the effect of compaction of natural snow is created.

2 Claims, 14 Drawing Figures

ARTIFICIAL SKI MATTING

BACKGROUND OF THE INVENTION

1. Field of the Invention

The invention relates to artificial ski matting, and more particularly, to a plurality of artificial ski mats which interlock to form a matting or artificial skiing surface.

2. Description of the Prior Art

Natural snow cannot always be counted on to be available during the ski season. Some ski areas attempt to solve this problem by manufacturing machine-made snow. However, the sub-freezing temperatures required to operate such machines to manufacture snow have often been absent for considerable periods of time. Winter rains and the like can wash out the snow provided either by nature or by man. In some areas, such as tropical climates, no natural snow skiing at all is possible. Finally, most ski areas are remote from large cities or the like. Skiers have always desired to be able to ski within easy reach of home in any season of the year.

Faced with these problems, man has attempted many solutions in the past to provide an artificial skiing surface. Grass, fine clay, fir tree cones, straw and even sand were first used without success. With the coming of plastic, various attempts were made to utilize plastic for artificial skiing. Problems in softness, durability, easy running surface, etc. were quickly encountered. Most skiers were turned off by the first artificial ski slopes. The stiff, molded bristles that were supposed to substitute for snow in some prior art arrangements ruined skis and falling on the bristiles resembled falling on a rake.

Other prior art surfaces utilized various configurations, such as bristly triangles and circles. Before taking off, skiers had to coat their skis with oil from a spinning roller. The surface was relatively rough and skis and poles caught in the triangles and circles. The arrangement of circles squares, triangles, etc., in some prior art surfaces, created an up-and-down effect due to air spaces which created a dangerous ski surface.

During the past 15 years, various attempts were made to solve these problems. Artificial ski surfaces have been used to cover slopes and trails extensively in both the U.S. and abroad but there surfaces have not proven economical in normally colder regions. However, use of these surfaces to provide a ski surface in limited areas where snow wear is extensive has become quite common. Chair lift loading and unloading ramps and uphill ski tracks for surface lifts were examples of areas where artificial ski surfaces have proven to be most acceptable.

It can be seen, therefore, that attempts to cover large downhill areas have been primarily limited to southern areas where neither natural or machine-made snow is reliable. A number of prior art artificial skiing surfaces are discussed in an article entitled "Artificial Skiing Surfaces" appearing in the Spring 1973 issue of SKI AREA MANAGEMENT magazine at pages 52 and 53. These prior art surfaces have included metal bases with white bristles, rings of plastic projections molded into a rectangular base, plastic fibers molded into sheets, loose granules of plastic added to a synthetic turf base mat, etc., All of these have proven unsatisfacfory for one or more of the following reasons. Such unsatisfactory characteristics include surfaces which have too high a coefficient of friction so that a ski does not slide easily thereon. Oiling of, or application of other substances to, skis or the like is messy, expensive, and does not solve this problem of slidability, particularly when used on relatively slight inclines. Temperature creates quite a problem with many artificial ski surfaces. For example, warpage may occur above a particular temperature. Some plastics may disintegrate under pressure and friction during use. Many of these prior art surfaces are formed by joining sections together. Such joining means has proven unsatisfactory. Some of these surfaces do not present an adequate resistance to the turning skis thereon. That is, the skis cannot dig in and compact as in natural snow.

Construction of some artificial ski surfaces is dangerous in that metal rings or pieces are used such that a user can be cut thereon. Some bristles are so hard and brittle as to cause injury in falling on them. Some surfaces require complicated anchoring means to make them stable and tend to slip on slopes over a certain number of degrees from the horizontal, e.g., slopes of over 15° to 20°. Finally, some surfaces are constructed in a manner forming dangerous edges or spacings caused by undesirable separation whereby ski edges, ski poles, etc. may catch thereon and cause the skier to fall.

There thus exists a need for an artificial ski material which avoids all of the problems of the prior art, is relatively inexpensive and can be quickly and easily installed.

SUMMARY OF THE INVENTION

It is an object of this invention to provide an artificial ski matting having characteristics similar to snow for skiing.

It is a further object of this invention to provide such an artificial ski matting which is comprised of a plurality of interlocked mats.

It is still another object of this invention to provide such an artificial ski matting which is durable, can be quickly and easily mounted on any desired terrain and is relatively inexpensive.

These and other objects are preferably accomplished by providing an artificial ski mat which includes a base ski support surface and a plurality of spaced "fluff" pegs having flexible "fluff" fingers on each "fluff" peg. A second plurality of spaced "turn" pegs are interposed on the mat between the "fluff" pegs having flexible "turn" fingers on each "turn" peg. The "fluff" fingers form a generally horizontal ski surface permitting skis to sink into the fluff fingers and track on the mat as a ski would do in natural snow. The "turn" fingers form a generally horizontal ski surface at a level lower than the first-mentioned horizontal ski surface permitting skis to dig into the mate and "turn" thereon. Finally, the base ski support surface supports the skis when they dig down into the mat, such as when sufficient centrifugal force is created in a dip or turn while skiing. In this manner, the effect of compaction of natural snow is created.

A plurality of these mats may be interlocked to form a matting which can cover a large surface thus forming a ski run or the like.

DESCRIPTION OF THE PREFERRED EMBODIMENT

Figure 1:
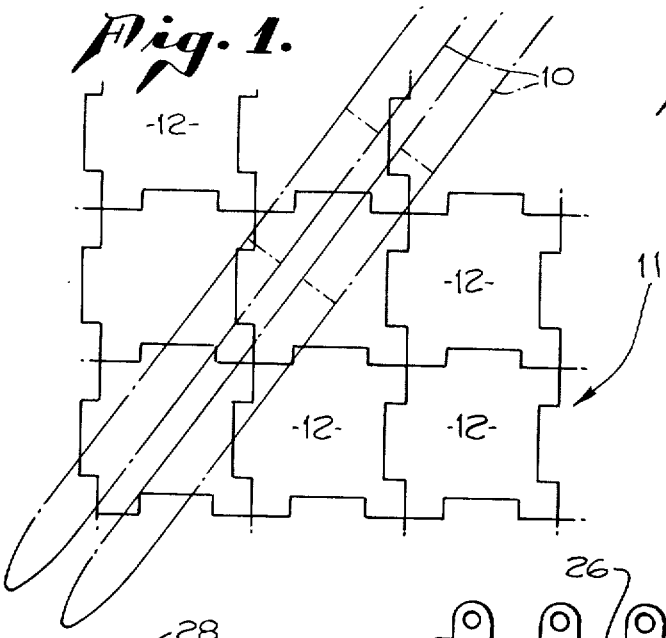
FIG. 1 is a top plan view of a pair of skis disposed on an artificial ski matting in accordance with the invention.

Referring to FIG. 1 of the drawing, skis 10 are shown skiing over an artificial ski matting 11 as particularly contemplated in the present invention. As indicated, a plurality of interlocking individual artificial ski mats 12 make up matting 11. The boundaries between interconnected mats 12 are irregular for reasons to be discussed further hereinbelow. That is, as can be seen in FIG. 2, each mat 12 is irregular in shape so that a like configured mat 12 may be interconnected thereto in a manner to be described also hereinbelow.

Figure 3:
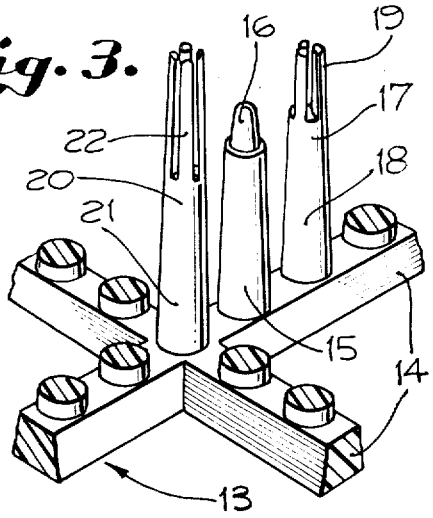
FIG. 3 is a partly sectional perspective view of a portion of the ski mat of FIG. 2.
Figure 2:
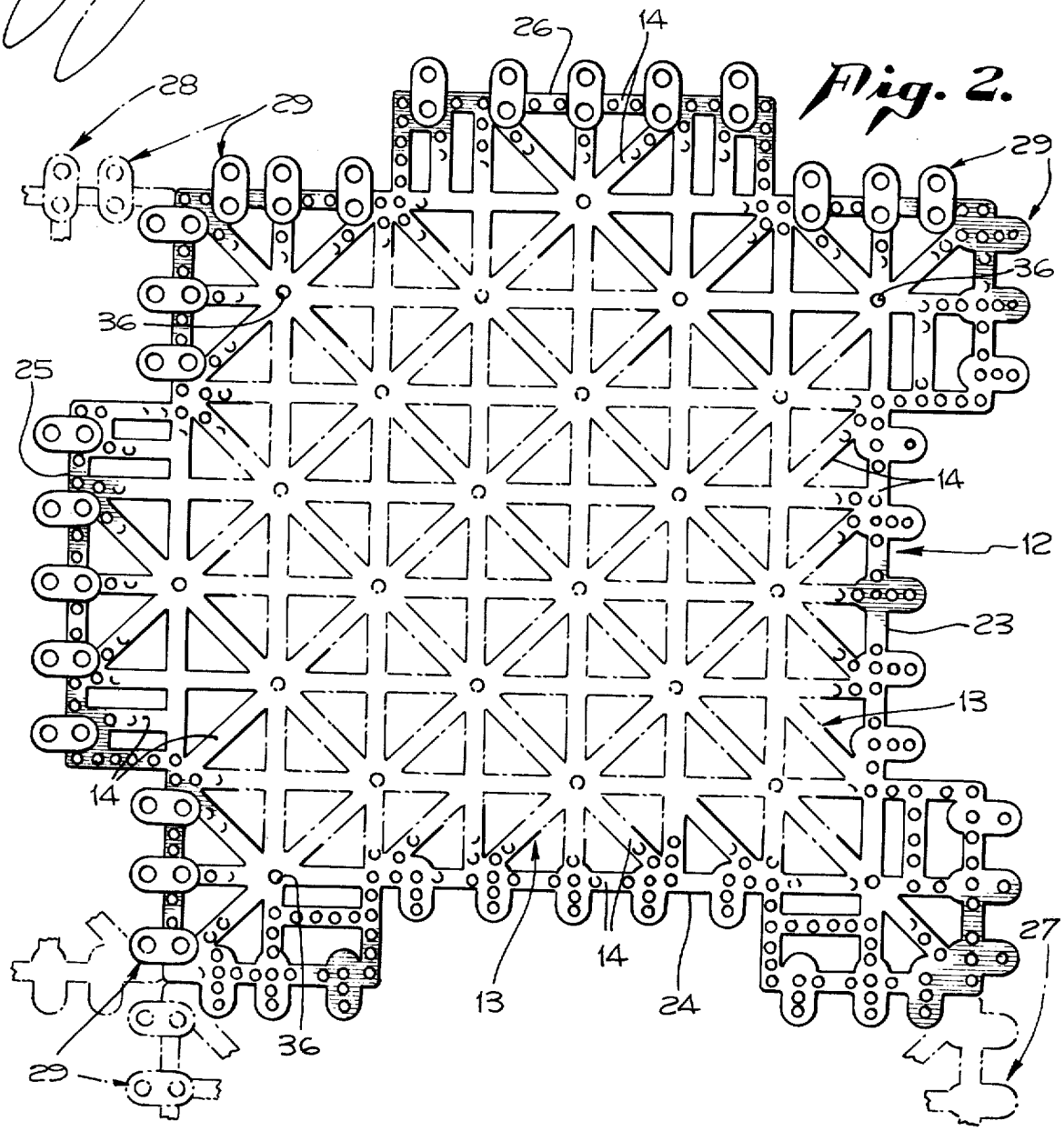
FIG. 2 is a top plan view of one section or ski mat of the ski matting of FIG. 1 showing the interconnection of adjacent mats in phantom.

As can be seen in FIGS. 2 and 3 each mat 11 includes a main base portion 13. Although base portion 13 may be any suitable configuration, it is illustrated as being comprised of a plurality of elongated horizontal, vertical and diagonal intersection ribs 14 which form an integral lace-like section. However, base portion 13 may be solid, if desired, and merely is comprised of interconnected ribs 14 for purposes of economy, weight and better drainage. These ribs 14 are also shown as generally trapezoidal in cross-section but again may be of any suitable configuration.

As particularly contemplated within the present invention, each mat 11 includes means thereon for simulating the effect of skiing on natural snow. Thus, in the exemplary embodiment, base portion 13 includes a plurality of spaced upstanding generally rigid base pegs 15 (see FIG. 3) which may be integrally formed on ribs 14 and may include a generally conically shaped rounded tip or head portion 16. The rounded tip 16 lessens contact of the undersurface of a ski therewith as will be discussed further hereinbelow, base pegs 15 may be eliminated, if desired.

A plurality of spaced upstanding "turn" pegs 17 (see also FIG. 3) are provided on ribs 14, each turn peg 17 including a lower generally rigid main body portion 18 and an upper generally flexible portion in the form of a plurality of elongated spaced flexible "turn" tips or fingers 19.

A plurality of spaced upstanding "fluff" pegs 20 (see FIG. 3) are provided on ribs 14, each fluff peg 20 including a lower generally rigid main body portion 21 and an upper generally flexible portion in the form of a plurality of elongated spaced flexible "fluff" tips or fingers 22. As will be explained in more detail further hereinbelow, "fluff" fingers 22 extend above "turn" fingers 19 and are relatively more flexible.

As shown in both FIGS. 2 and 3, pegs 15, 17 and 20 are relatively closely spaced on ribs 14 and are generally disposed thereon in a 1:1:1 ratio, that is, a turn peg 17 is adjacent a base peg 15, base peg 15 being adjacent a fluff peg 20, fluff peg 20 being adjacent a second base peg 15, etc.. That is, preferably, a base peg 15 always separates a turn peg 17 from a fluff peg 20. However, as will be discussed with regard to FIG. 4, the pegs may be disposed on ribs 14 in such a manner that certain like pegs may be adjacent one another at the intersection of the ribs 14.

Referring once again to FIG. 2, each mat 12 is generally irregular in outline. For example, mat 12 in FIG. 2 has cut-out portions 23 and 24 which conform to outwardly extending portions 25 and 26, respectively, directly opposite their respective portions. The remaining periphery of each mat 12 is likewise configured so that a plurality of mats 12 may be interlocked to form the matting 11 of FIG. 1. However, the irregular configuration of each mat 12 eliminates any straight line effect which would be detrimental to a skier as will be discussed further hereinbelow and which is illustrated in FIG. 1.

FIG. 2 shows in dotted lines a second mat 27 positioned for connection at the bottom portion of mat 12. A third mat 28 is shown in dotted lines positioned on the left side of mat 12. Other mats would be joined in like manner. The means for connecting such mats are shown in FIG. 2 in both solid and dotted lines (indicated generally at 29) and will be discussed more fully with respect to FIGS. 4–7.

Figure 4:
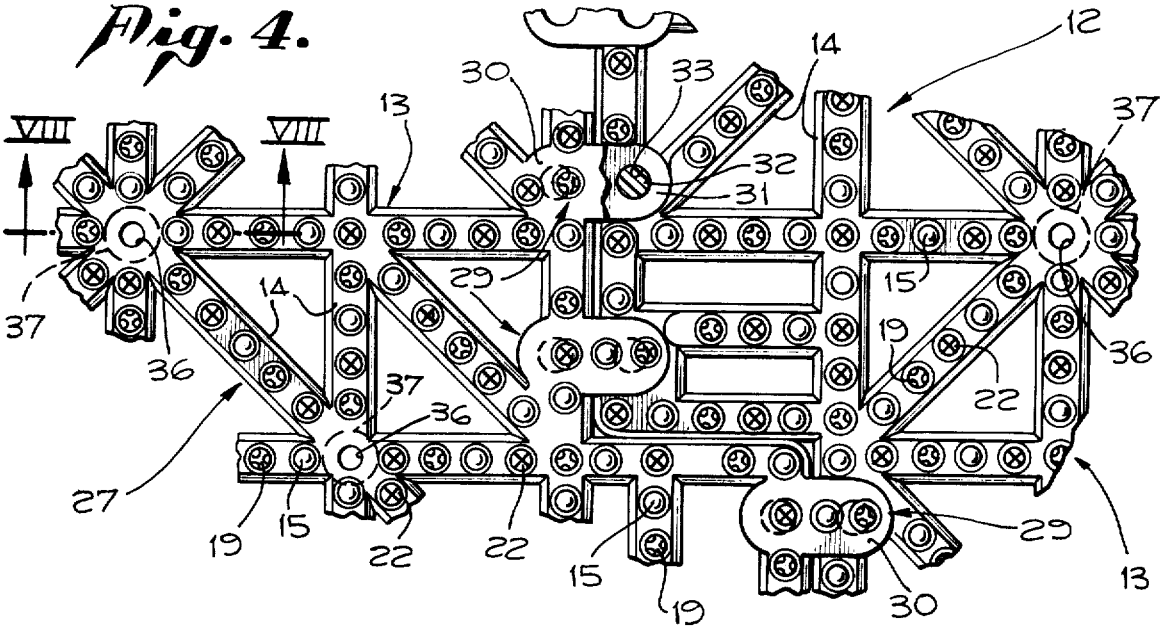
FIG. 4 is a detailed view showing the interconnection of a pair of ski mats in accordance with the teachings of the invention.

Referring now to FIG. 4, a first mat 12 is shown interconnected to a second mat 27. As shown, each mat 12, 27 includes connecting means 29 thereon. It can also be seen that the base, turn and fluff pegs 15, 17 and 20 are staggered on mats 12, 27 so that various types of pegs 15, 17 and 20 are encountered in any straight line. Also, these pegs 15, 17 and 20 are densely provided on mats 12, 27 so that a cross-sectional view of each mat 12, 27 will present an extremely dense grouping of pegs as will be discussed further hereinbelow. These pegs may be arranged so that certain like pegs are adjacent one another at the intersection of various ribs 14.

Figure 5:
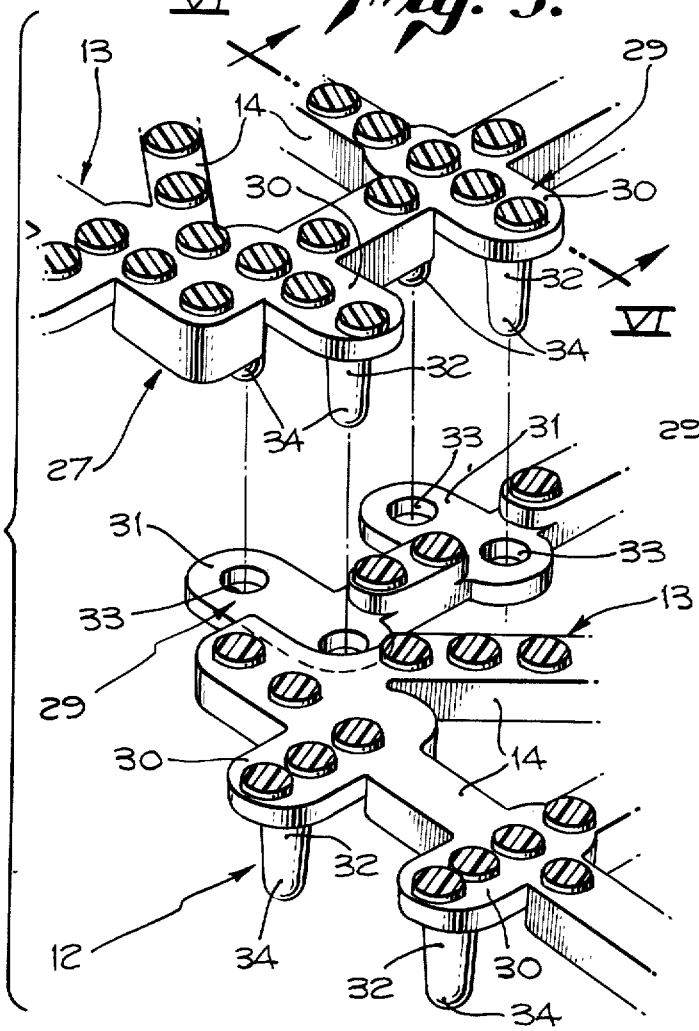
FIG. 5 is an exploded view illustrating the interconnection of a pair of mats.

As particularly contemplated by the invention, such connecting means 29 includes undercut extension portions or tabs 30 on one side of each mat and oppositely undercut extension portions or tabs 31 on the other side of each mat (shown as tabs 30 on one mat 27 in FIG. 5 with tabs 31 on the other mat 12 it is to be understood that the thickness of each tab is related to the width of the undercut portion of the rib 14 on which the corresponding tab is formed so that, when interconnected, the pegs of adjacent interconnected mats are at the same height).

Thus, tabs 30 include one or more downwardly extending connecting pegs 32 which engage one or more corresponding openings or connecting holes 33 in tabs 31. The exact position, number and location of tabs 30, 31 on ribs 14 is a matter of choice.

Figure 6:
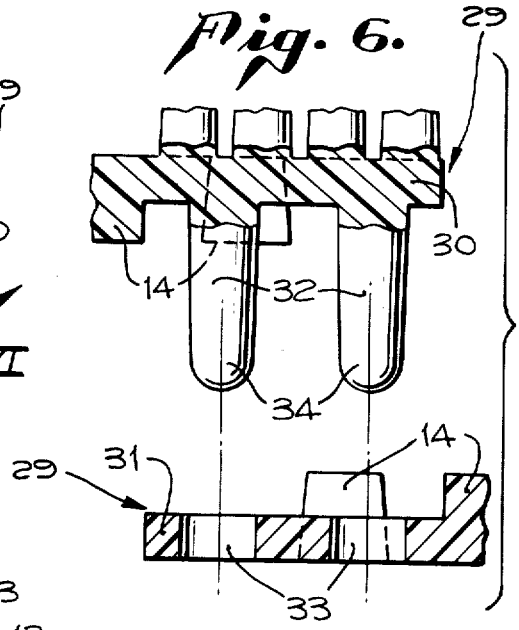
FIG. 6 is a cross-sectional view taken along lines VI—VI of FIG. 5.
Figure 7:
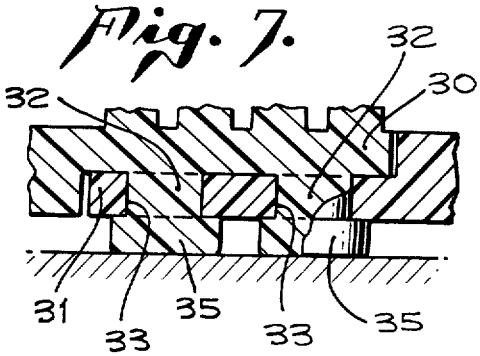
FIG. 7 is vertical sectional view of the portion of the mats of FIG. 6 after interconnection thereof.

FIG. 6 illustrates how connecting pegs 32 are inserted into connecting holes 33. After insertion the terminal ends 34 are upset, as by heat welding or ultrasonic assembly or the like, to form enlarged upset rivet heads 35. This may be accomplished by simultaneously treating all connecting pegs 32 by reversing the mats and applying heat or the like thereto. Thus, all the heads 35 would be substantially the same thickness and the interconnected mats would all be at substantially the same height.

Figure 8:
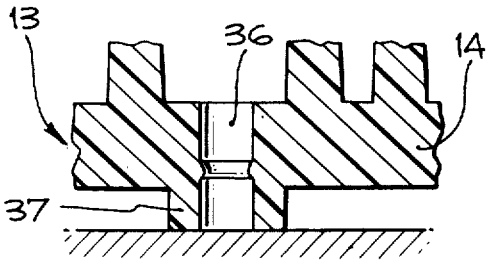
FIG. 8 is a detailed vertical sectional view of a portion of one of the mats of FIG. 4.

Referring now to FIG. 8, the ribs 14, as shown in FIG. 2, intersect at various points with holes 36 formed at such intersection. As shown in FIG. 8, these holes 36 extend all the way through the intersection of ribs 14 and also through a button member 37 which is formed on the underside and may be integral with the ribs 14. This button member 37 may be any suitable width and is of a length so that when the aforementioned heads 35 are formed, the heads 35 are simultaneously flattened to the same length as members 37.

Figure 14:
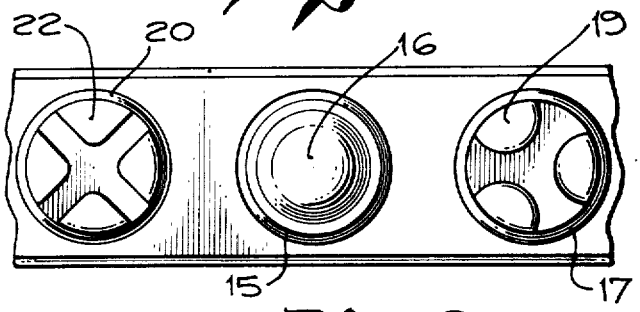
FIG. 14 is a top plan view showing a portion of the mat of FIG. 2.
Figure 13:
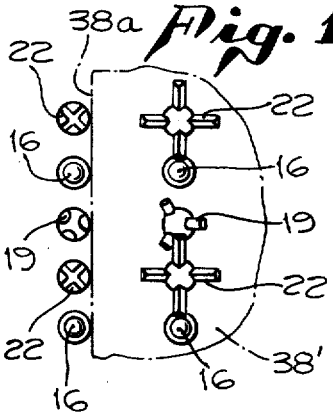
FIG. 13 is a top plan view showing a transparent portion of a ski fluffing over the surface of the mat of FIG. 9–12 taken along lines XIII—XIII of FIG. 10.
Figure 9:
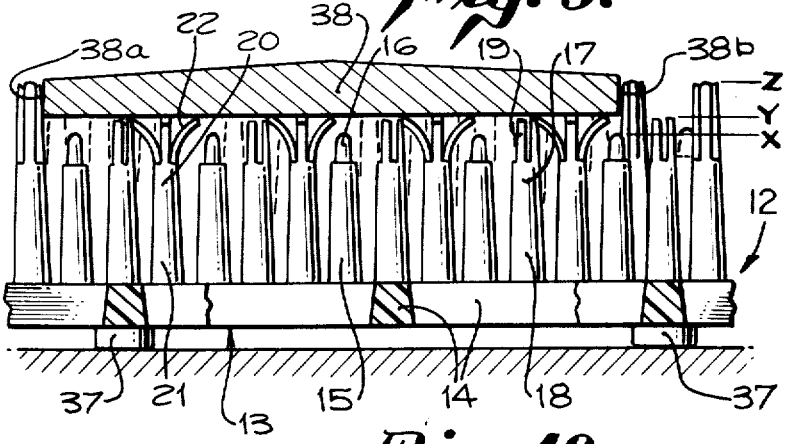
FIG. 9 is a vertical view, partly in section, of a portion of the mat of FIG. 8 showing a ski fluffing thereon.

FIG. 9 FIGS. 13 and 14 illustrate the staggerd relationship of pegs 15, 17 and 20. It can be seen that the uppermost extremities of all the head portions 16 of base pegs 15 lie in generally the same horizontal plane X. The uppermost extremities of all of the turn fingers 19 of turn pegs 17 lie in generally the same horizontal plane Y, this plane being generally slightly vertically above plane X. Finally, the uppermost extremities of all of the fluff fingers 22 of fluff pegs 20 lie in generally the same horizontal plane Z, this plane being generally slightly higher than plane Y. Although the distances between planes X, Y and Z may vary, as will be discussed hereinbelow with regard to the preferred number, placement and dimensions of pegs 15, 17 and 20, the distance between planes may be on the order of above 0.200 inches. This distance may range from about 0.150 to 0.500 inches.

FIG. 9 illustrates how a ski 38 sinks into the fluff tips or fingers 22 and tracks on mat 12 (or matting 11) which fingers 22, being flexible, bend in its path thus simulating tracking in natural snow. The outer edges of ski 38 engage pegs 15, 17 and 20 which serve to guide ski 38 and form a track therefore in mat 12 as shown in FIG. 13.

Figure 10:
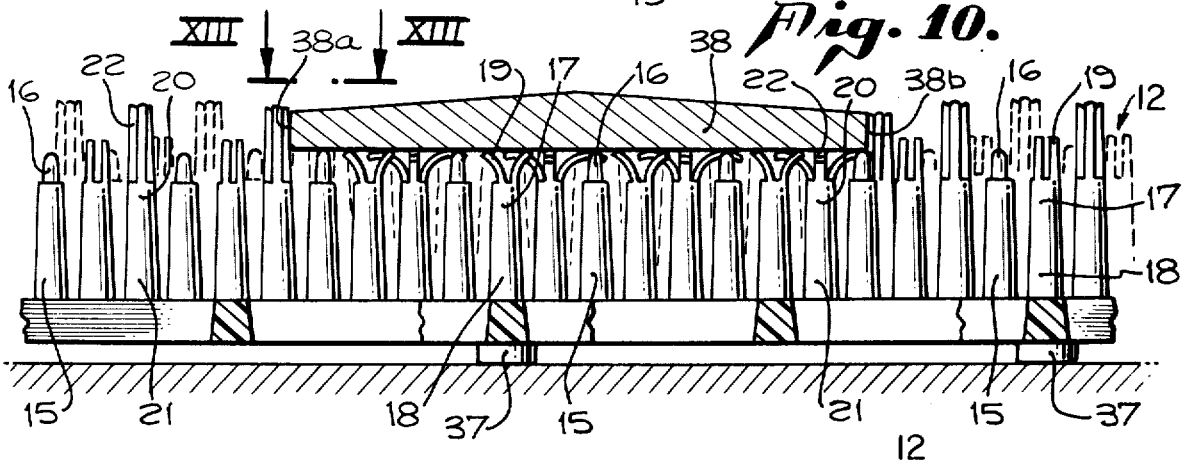
FIG. 10 is a view similar to FIG. 9 showing a ski supported on the base of the mat thereof.
Figure 11:
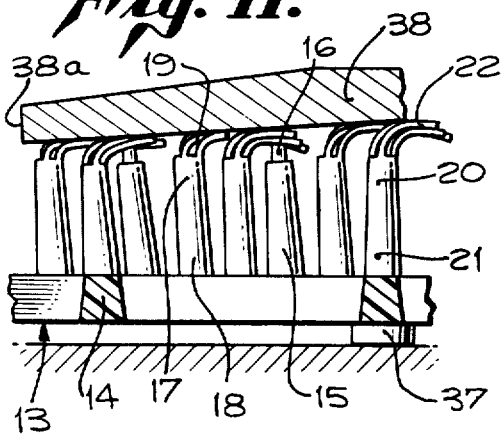
FIG. 11 is a view similar to FIG. 9 showing a ski turning on the surface thereof.

FIG. 10 illustrates how ski 38 digs down and is supported in mat 12 (or matting 11) by base pegs 15. Fluff fingers 22 are bent even further than turn fingers 19 and ski 38 now digs into 12. As ski 38 turns, turn fingers 19 are flexed even more as illustrated in FIG. 11 until ski 38 engages the tips 16 of base pegs 15. Depending upon the angle of the turn and where the weight on ski 38 is concentrated, some fingers 19 and 22 are flexed more than others. Of course, although the pegs 15, 17 and 20 have been described as having generally rigid main body portions, these portions may also flex as the weight of the skier is put on the mat 12. This simulates compaction of natural snow and builds up compaction in the mat 12 (or matting 11) by bending all the turn and fluff pegs 17 and 20 in its path but not necessarily the base pegs 15 (or only to a slight degree if a solid base were used in place of pegs 15, no bending would of course take place). Since the interconnection of the mate is irregular and not a straight line, the ski can turn at any point without catching on a linear edge. This is illustrated in FIG. 11 where some of these main body portions flex slightly in the direction of turn of ski 38. It can therefore be seen that a ski sinks down and tracks in matting 11 and can turn thereon in a compacting movement just as it would make its own track and turn in natural snow.

Referring to FIG. 14, although a plurality of fluff fingers 22 and turn fingers 19 have been described, any suitable number may be used. For example, four flexible fluff fingers 22 may be provided as shown in FIG. 14. Three turn fingers 19 may be provided also as shown in FIG. 14. The actual number of both fingers 19 and 22 may vary depending upon the type of ski run desired.

FIG. 13 illustrates how ski 38' (which is transparent) bends fluff fingers 22 as it glides over mat 12 whereas fingers 19 and 22 and tips 16 at its edges **38*a* and 38*b* serve to form a track for ski 38' (the exact number and placement of fingers and tips 16** may vary).

Although a plurality of pegs 15 have been described for forming the base support for ski 38, the entire base portion 13 may be solid or hollow and of one integral piece with pegs 17 and 20 upstanding therefrom.

Although many materials may be used to form mats 12, plastic is preferred since it is the most economical way to form the mats and retain the advantages of my invention. For example, any suitable resilient material, such as polyethylene, may be used. The mats 12 may thus be formed as one integral section; i.e., pegs 15, 17, and 20 and ribs 14 are formed simultaneously in one integral piece.

The irregular configuration of each mat 12 eliminates the straight-line effect when connecting one or more mats 12 to form matting 11 as shown in FIG. 1. Thus, the edge of skis 38 would not catch on the intersection of the interconnection mats due to this zig-zag effect.

The mats 12 may be formed in any suitable dimensions, as for example, each mat 12 being one square foot. Thus, pegs 15, 17 and 20 may be disposed thereon in a 1:1:1 ratio. For example, the spacing between the centerlines of these pegs may be about 0.290 inches or so resulting in 333 base pegs 15, 333 turn pegs 17 and 333 fluff pegs 20 using pegs of approximately 0.210 inches in overall diameter. This spacing may of course vary, e.g., from about 0.100 to 1.00 inches resulting of course in a reduction in the total number of pegs. This ratio may also vary. For example, the 1:1:1 ratio may be optimum for normal ski runs or the like; however, the terms "ski mats" or "ski matting" used throughout this specification may also refer to other natural snow runs, such as a toboggan or bobsled run. In these latter cases, a differing ratio of pegs may prove optimum since "fluffing" may not be necessary. For example, a 6:3:1 ratio of base pegs 15 to turn pegs 17 to fluff pegs 20 may be used.

The mats 12 may be colored in any suitable manner to give a pleasing effect. Although white may be used to simulate snow, white plastic would color and deteriorate quite rapidly when exposed to light and ultraviolet radiation. Although chemicals well known to the artisan could be added in the manufacture of mats 12 to stabilize such degradation, such chemicals are quite expensive. I have found that coloring these mats 12 green gives both a pleasing effect, reduces the need for the addition of chemicals and prolongs their useful life. Black of course, would be optimum but not as aesthetically pleasing.

As discussed hereinabove, various materials may be used to form mats 12. Preferably, such material should be capable of being molded into mats 12 and have great strength and durability. The pegs and fingers formed on mats 12 should flex under pressure, as the degree of flexing varying of course with the weight of the skier and the centrifugal force. Thus, suitable materials may include nylon, vinyls, such as polyvinyl chloride and ethylenevinyl acetate, polyurethanes, polyethylene, etc.

The overall height of pegs 15, 17 and 20 may vary; for example, pegs 20 may range from about 0.500 to 3.00 inches in overall height with the pegs 15 and 17 being of lesser heights accordingly. The outer diameter of pegs 15, 17 and 20 may vary, as for example, from about 0.050 to 1.00 inches (channeled tubing and solid peg ends of various heights may be used). The spacing between the longitudinal central axes of pegs 15, 17 and 20 may also vary depending of course on the peg diameter, e.g., from about 0.100 to 1.00 inches. As discussed, pegs 15, 17 and 20 may be solid or tubular with split upper parts or solid upper parts that are then molded so as to to form head portions 16 and fingers 19 and 22. The ribs 14 may be solid or channeled and tapered, as shown, or square, rectangular or any other suitable configuration and may range from a thickness of about 0.100 to 1.00 inches.

It should be appreciated that each peg 15, 17 and 20 is designed as a unit which in turn performs two separate functions. This separation of functions occurs at the transition line, i.e., the intersection of the main body portion of each peg 15, 17 and 20 with its tip portion 16, turn fingers 19 and fluff fingers 22, respectively where in all three types of solid, round, and tapered part of each respective peg changes its shape and density; i.e, fluff peg 20 to four fluff fingers 22, turn peg 17 to three turn fingers 19, and base peg to a tip portion 16 which may be formed by a tip portion 16 which is inserted into its main body portion 15a and thus gradually tapers to a rounded tip or crown. Fluff pegs 20 are designed to offer the least resistance, turn pegs 17 offer more resistance, and base pegs 15 offer the most resistance. Since plastic of a pliable nature and inherent "snap back" qualities is preferably used, the following occurs when pressure is exerted against it. With pressure, each type of peg 15, 17 and 20 resists and then bends according to its strength of design, and, as pressure is decreased, it will bend back and arrive at its original position when all pressure has been eliminated. This is most clearly illustrated in FIG. 12. It can be seen that fluff fingers 22 can straddle either tip portion 16 or turn fingers 19 (depending upon the juxapositioning of the various pegs). Turn fingers 19 may in turn straddle an adjacent tip portion 16. The main body portions 20, 17 and 15 may flex in turn, then return to its original position. Thus, compaction of natural snow is simulated.

EXAMPLE

One square foot of a mat 12 in accordance with the teachings of my invention may have pegs 15, 17 and 20 as follows:

| | | |
|---|---|---|
| 300 fluff pegs 20 with 4 fingers 22 each or: | 1,200 | vertical fluff fingers 22 |
| 312 turn pegs 17 with 3 fingers 19 each or: | 936 | vertical turn fingers 19 |
| 312 base pegs 15 or: | 312 | vertical base pegs 15 |
| | 2,448 | total vertical fingers or pegs per sq. ft. |

Thus: 2,448 × 3 (i.e., the average sq. ft. of a conventional ski bottom area) equals: 7,344 vertical supports under a ski bottom at any given moment.

Structural strength has been so built in that, regardless of the angle between two adjacent mats 12 at any joining point, no strength or resiliency loss occurs. Thus, whether the ski bottoms are sliding flat or are in a severe banked turn condition while crossing from one mat to another, all conditions of density, pressures, compaction, and centrifugal force remain constant. Lack of such strength has been one of the major problems in all known prior art artifical skiing surfaces.

Two unattended skis, such as skis 10 in FIG. 1, lying on a mat surface depress imperceptibly into the fingers 22 of fluff pegs 20 since their total unloaded weight distributed over the square inch area of the ski bottoms are resting on thousands of vertical fluff fingers 22. For example, a 3 inch-wide × 72 inch-long ski equals 216 sq. in per ski (times 2 for 2 skis) equals 432 sq. inches or 3 sq. feet of total ski bottom area. Therefore, 300 fluff pegs 20 per sq. ft. × 3 sq. ft. area equals 900 fluff pegs 20 × 4 fingers 22 per peg 20 equals 3,600 fluff fingers 22 alone supporting the ski bottoms. This heavy density of fluff fingers 22 (which stand at least 0.200 inches higher than the other type fingers 19 or tip portion 16) is designed to create a soft and pliable uppermost surface so that a skier's fall is amply cushioned by it.

Such density of fluff finger construction over an entire ski run matting area is such that given a degree of angle of 7 ° or more, unattended skis will slide downhill or "run away" (a term used in snow skiing when this same condition occurs). Most prior art surfaces indicate that the degree of slope angle should be at least 20° to 30° for their type of synthetic skiing product to work. This is considerably more than required. by my artificial ski matting. Furthermore, a 30 ° slope is so frightening to a beginning skier that it is difficult for him to learn on plus his angle of fall is extremely steep.

With the weight of a skier added, the flat bottom side of the skis depress each four independently acting fluff fingers 22 so that they are touching to whatever degree of angle they are forced to go by pressure exerted by the ski bottom as shown in FIG. 9. All the fluff fingers 22 not touched by the outside edges of the skis remain upright thus giving side support on each side of both skis as they slide along as shown in FIG. 13. This creates the same situation that occurs when a ski on snow sinks down into it and makes its own individual track; thus, I have created for the ski both a synthetic and mechanical method for it to maintain its directional stability.

Figure 12:
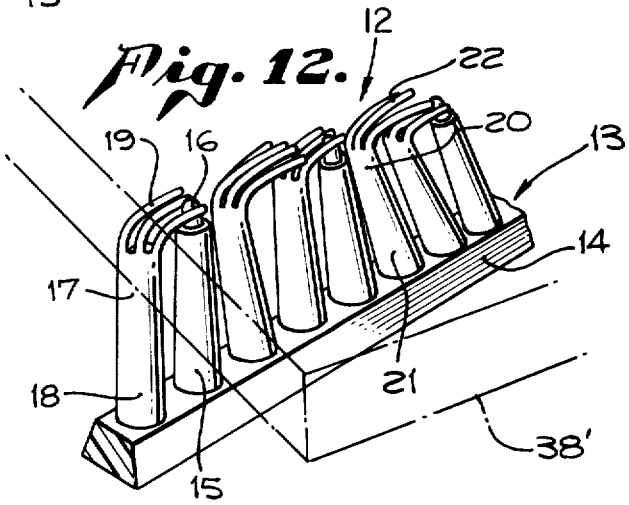
FIG. 12 is a plan view showing a transparent ski portion on the mat of FIG. 2.

Having sunken through the fluff fingers layer, the ski bottoms now slide over the tops of the vertical turn peg fingers 19 with each turn peg 17 having three independently operating fingers 19. These fingers 19 are thicker, stronger, and more resistant to pressure than the fluff fingers 22, but are still resilient. The skis continue to slide flat and in a straight line in this fashion being guided in their fluff track until such time as a turn is initiated by the skier causing the flat ski bottoms to bank either left or right into the matting as shown in FIG. 11. At this moment, centrifugal force is applied to the fluff pegs 20 and fingers 22 and also to the turn pegs 17 and fingers 19. As the degree of turn and angle of bank of the ski bottoms increases, so does the weight and pressure on both types of pegs 17 and 20 and fingers 19 and 22 since the overall weight distribution on the ski bottoms is increased to a smaller area (as the upper part of the banking ski bottoms are clear of mat 12 and no longer in contact with any fingers 19 or 22). This increase pressure forces the longer fluff fingers 22 and pegs 20 to bend over and press against the turn fingers 19 and pegs 17. When pressure is sufficient, fluff fingers 22 are so designed that they will flow through and around turn pegs 17 and fingers 19 by the process of splitting and bending around the turn pegs 17 or by splitting and bending through the turn fingers 19 as shown in FIG. 12.

Additional increased turning and centrifugal force pressure forces the ski bottoms down through both the fluff and turn finger layers until the ski bottoms are resting on and sliding over the base pegs 11. (see FIG. 15). In maximum pressure turns (such as an abrupt, complete stop from high speed) the fluff fingers 22 and pegs 20 bend over against and push around and through the turn fingers 19 and pegs 17. These both in turn also bend over against and pushing around the base pegs 15. The base pegs 15, although most resistant of the three types of pegs 15, 17 and 20, also bend over according to the pressure exerted from the fluff fingers 22 and pegs 20, turn fingers 19 and pegs 17, and direct contact pressure from the ski bottoms as shown in FIG. 12.

Thus, a profusion of intermingling pegs and fingers is purposely created and controlled step-by-step as increased or decreased pressures occur. This controlled compaction either at increasing or decreasing pressures causes the ski bottoms and their edges to react in the same manner as they do when snow is compacted under pressure by them.

Finally, all the pegs 15, 17 and 20 are preferably interchangeable so that, in manufacturing, an infinite number of ratio combinations are possible in order to create density, pressure, and compaction resistance of different degrees between various peg types to accommodiate particular conditions required for downhill skiing, nordic skiing, tobogganing, bob-sledding, skibobbing, or snowmobiling.

In summary, the peg structure on mats 12 may vary depending upon the use to which mats 12 are to be put. Examples of such use are runs such as toboggan, bobsled, skibob, ski (both downhill and cross-country), saucer and snowmobile.

Although any suitable density may be used for the placement of pegs 15, 17 and 20 on mats 12, the density should be such so as to prevent either injury to a falling skier or catching on the mat of the body or clothing of the skier. The staggered arrangement of pegs on intersecting ribs are shown in FIG. 4 is only one suitable arrangement. Further, the ski poles used by the skier will not catch in my mats 12 as in other prior art devices. The distance between the tips and baskets of ordinary ski poles may be varied or adjusted, if desired, so that the overall length between the bottom of the basket and the extreme tip of the ski pole is no greater than the overall thickness of mat 12 (i.e., the bottom of mat 12 and the tips of the fingers).

Skis track very easily over the mats 12 of my invention, The irregular configuration of mats 12 eliminate edge catching of skis. Unintentional side slipping or yawing is also eliminated.

Although various prior art devices required a 25° slope or the like to permit a ski to slide smoothly thereon, my matting 11 can be used on a 7° or 8° slope or less permitting beginners to ski thereon.

Since each mat 12 as disclosed in the exemplary embodiment may weigh about 2 pounds, these mats 12 may be laid right over dirt or grass or the like and stay in position. If desired, a thick cushion, such as a cushion 2 to 3 inches thick, of a suitable material, such as, for example, indoor-outdoor carpeting, such as Paratex, a carpeting of pure horsehair and hog hair in an emulsion manufactured by J. A. Bloxom Co. of New Jersey, may be laid under matting 11 to provide a cushioning effect, avoid dust problems, etc.

Although mats 12 have been disclosed as being used to form a matting 11, these mats 12 may be used to patch bare or rocky spots in a normal natural snow ski run and can even be used for ski jumping. Holes as large as 12 inches or so in diameter may be covered over with matting 11 without any need for undersupport. If laid over rock or the like, wire may be ram-set or the like into the rock and the matting 11 secured thereto in any suitable manner, such as rings or hooks encircling both ribs 14 and the laid-down wire. Of course, such wire may be first laid down anywhere it is desired to secure matting 11 thereto. Holes 36 may also be used, as for example, to secure matting 11 to plywood or the like by inserting screws or the like through holes 36 and into the plywood.

It can be seen that I have described hereinabove an artificial ski matting which has a high coefficient of friction so that skis can slide easily thereon. The material comprising my matting can withstand a wide range of temperature and does not disintegrate under pressure and friction. Warpage does not take place regardless of the temperatures encountered in normal use. The mats making up the matting are joined together in a relatively simple manner rigidly interlocking adjacent mats together. The fibers or flexible fingers provide effective directional hold on the skis and resistance to turning thereon. When laid out, the matting of my invention is relatively stable, does not shift during use and will not slip on slopes of over 15°–20° or so. Ordinary clothes, such as denim trousers or the like, may be worn by the skier.

Although a particular arrangement of pegs 15, 17 and 20 have been described in a preferred embodiment of the invention, the ratio and total number and spacing therebetween may vary. Further, base pegs 20 may be eliminated entirely as discussed hereinabove. Finally, although three pegs 15, 17 and 20 of varying heights have been disclosed, a plurality of such pegs varying in height may be used, depending upon the cost, type of compaction desired, etc. For example, adjacent pegs may be arranged in a manner whereby a fluff peg of one height is adjacent a fluff peg of lower height followed by a turning peg of a still lower height, a second turn peg of even lower height, a base peg of lower height, etc. These pegs may also vary so that a first fluff peg of one height is adjacent a second fluff peg of differing height, etc. Thus the arrangement of pegs the relationship of their heights and the number of fingers of each peg is only to be limited by the appended claims.

I claim as my invention:

1. An artificial ski mating comprising:

a plurality of interconnected artificial ski mats, each of said mats including a relatively rigid base formed of resilient interconnected and intersecting ribs, a first plurality of spaced resilient base pegs extending vertically upwardly from said ribs, each of said base pegs being substantially the same height and terminating in a rounded upper surface forming a generally horizontal ski support surface, a second plurality of spaced resilient turn pegs extending generally vertically upward from said ribs and integral therewith, each of said second plurality of turn pegs having a generally frustoconically shaped main body portion, each of said body portions terminating at their upper ends in a plurality of generally vertically upwardly extending spaced elongated turn fingers more flexible than said body portions and of subtantially the same overall length forming a generally horizontal ski turn surface vertically spaced from said ski support surface; said turn pegs being spaced from said base pegs; and a hird plurality of resilient fluff pegs extending generally vertically upwardly from said ribs and integral therewith spaced from said base and turn pegs, each of said third plurality of fluff pegs having a generally frustoconically shaped main body portion, each of said last-mentioned main body portions terminating at their upper ends in a plurality of generally vertically upwardly extending spaced elongated flexible fluff fingers of substantially the same overall length and of an overall height greater than the overall height of the flexible fingers of said second plurality of pegs and more flexible than said last-mentioned main body portion, the uppermost ends thereof forming a generally horizontal ski fluff surface vertically spaced from said horizontal ski turn surface, each of said fluff fingers being more flexible than each of said turn fingers;

each of said base pegs being disposed between one of said turn pegs and one of said fluff pegs, at least a plurality of said pegs being disposed on each of said mats in a 1:1:1 ratio of said base pegs to said turn pegs to said fluff pegs;

connecting means associated with each of said mats for interconnecting said mats in a manner whereby the uppermost portions of all of said bases and fluff and turn fingers of all of said interconnected mats lie generally in the same respective horizontal plane; and each of said mats having approximately a four-sided configuration, at least some of said sides being non-linear in configuration and a mirror image of its opposite sides, said connecting means including downwardly extending connecting pegs on one of said sides and connecting peg receiving holes on the opposite sides receiving said connecting pegs therein, each of said mats being undercut in the vicinity of said connecting pegs and oppositely undercut in the vicinity of said connecting peg receiving holes so that the uppermost portions of all of said bases and said turn and fluff fingers of all of said interconnected mats lie generally in the same respectively horizontal plane, the connecting pegs extending through said connecting holes and including upset rivet heads at their terminal ends of a width greater than the diameter of said holes thereby fixedly securing said connecting pegs in said connecting holes, thereby rigidly securing one of said mats to the other forming a welded unitary matting, and the undersurface of the ribs of each interconnected mat having support means thereon cooperating with said heads for providing a resilient upwardly and downwardly movable cushioning surface adapted to simulate the compaction of natural snow that is made by a ski passing thereover as a ski passes over said matting.

2. The matting of claim 1 wherein said main body portions of said turn and fluff pegs and the base pegs are generally cylindrical in cross-section and from about 0.500 to 3 inches in overall height and from about 0.050 to 1.00 inches in outer diameter with the spacing between the centerlines of said base pegs and both said main body portions being from about 0.100 to 1.00 inches.

* * * * *